US005823822A

United States Patent [19]

Tan et al.

[11] Patent Number: 5,823,822

[45] Date of Patent: Oct. 20, 1998

[54] BRACKET WITH BOARDLOCKS FOR ARRANGING STACKED CONNECTORS

[75] Inventors: Haw-Chan Tan, Diamond Bar; Gordon Lok, Montebello; Joel J. Yeh, San Gabriel, all of Calif.

[73] Assignee: Hon Hai Precision Ind. Co., Ltd., Taipei Hsien, Taiwan

[21] Appl. No.: 746,248

[22] Filed: Nov. 7, 1996

[51] Int. Cl.[6] ..... H01R 13/73

[52] U.S. Cl. ..... 439/541.5

[58] Field of Search ..... 439/541.5, 79

[56] References Cited

U.S. PATENT DOCUMENTS

| | | | |
|---|---|---|---|
| 5,037,330 | 8/1991 | Fulponi et al. | 439/541.5 |
| 5,085,590 | 2/1992 | Galloway | 439/541.5 |
| 5,336,109 | 8/1994 | Hillbish et al. | 439/541.5 |
| 5,613,875 | 3/1997 | Yang | 439/541.5 |

*Primary Examiner*—Gary F. Paumen

[57] ABSTRACT

A stacked type connector assembly (10) includes an insulative bracket (12) defining an upper level portion (14) and a lower level portion (16) for respectively receiving a first connector (18) and a second connector (20) therein. A first mounting surface (24) is formed on the upper level portion (14) whereby the first connector (18) can be supportably mounted thereon, and a second mounting surface (30) is formed on the lower level portion (16) whereby the second connector (20) can be engageably attached thereto, wherein such first mounting surface (24) is disposed between a pair of side walls (22) while such second mounting surface (30) is composed of two abutment planes (36) disposed by two sides of such pair of side walls (22). A first pair of boardlocks (53) helpfully fasten the first connector (18) to the bracket (12) in the upper portion (14) thereof and a second pair of boardlocks (68) fasten the second connector (20) to the bracket (12) in the lower portion (16) thereof. The bracket (12) further provides a spacer structure (48) on the rear portion for aligning the contact tails (19) of the first connector (18) with regard to the board on which the bracket (12) with the first and the second connectors (18, 20) is mounted.

17 Claims, 3 Drawing Sheets

BRACKET WITH BOARDLOCKS FOR ARRANGING STACKED CONNECTORS

BACKGROUND OF THE INVENTION

1. Field of the Invention

The invention relates to mechanism for arranging two stacked connectors thereon, and particularly to the bracket device with boardlocks performing the fixation function with regard to such connectors.

2. The Related Art

To economically use the limited space within the computer case, stacked type connector assemblies are popularly used in the computer field, for example, U.S. Pat. Nos. 5,037,330, 5,085,590, 5,336,109. It is desired to have the stacked type connector assembly itself easy to be made or assembled, and serve reliable and convenient characteristics as a single unit connector with regard to the PC board on which such stacked type connector assemble is mounted. The copending patent application having the same assignee and Ser. No. 08/651,565, filed May 22, 1996, discloses a bracket providing an upper lever portion and a lower lever portion for arranging more than one connectors thereon so that a single stacked connector assembly is formed thereof. The bracket of such copending application is intended to be used with D-Sub type connectors with different pin numbers and lengthwise dimensions wherein the connectors on the lower level portion of the bracket are generally independently secured to the PC board on which the bracket is mounted. Somewhat differently, the invention of this application is designed to be used with a D-Sub type connector and a SCSI-III type connector wherein the connector on the lower level portion of the bracket is substantially secured to the bracket as well as the connector on the upper level portion of the bracket, whereby the bracket with its associated lower level connector and upper level connector can serve as one piece for mounting to the PC board easily.

SUMMARY OF THE INVENTION

According to an aspect of the invention, a stacked type connector assembly includes an insulative bracket defining an upper level portion and a lower level portion for respectively receiving a first connector and a second connector therein. A first mounting surface is formed on the upper level portion whereby the first connector can be supportably mounted thereon, and a second mounting surface is formed on the lower level portion whereby the second connector can be engageably attached thereto, wherein such first mounting surface is disposed between a pair of side walls while such second mounting surface is composed of two abutment planes disposed by two sides of such pair of side walls. A first pair of boardlocks helpfully fasten the first connector to the bracket in the upper portion thereof and a second pair of boardlocks fasten the second connector to the bracket in the lower portion thereof. The bracket further provides a spacer structure on the rear portion for aligning the contact tails of the first connector with regard to the board on which the bracket with the first and the second connectors is mounted.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
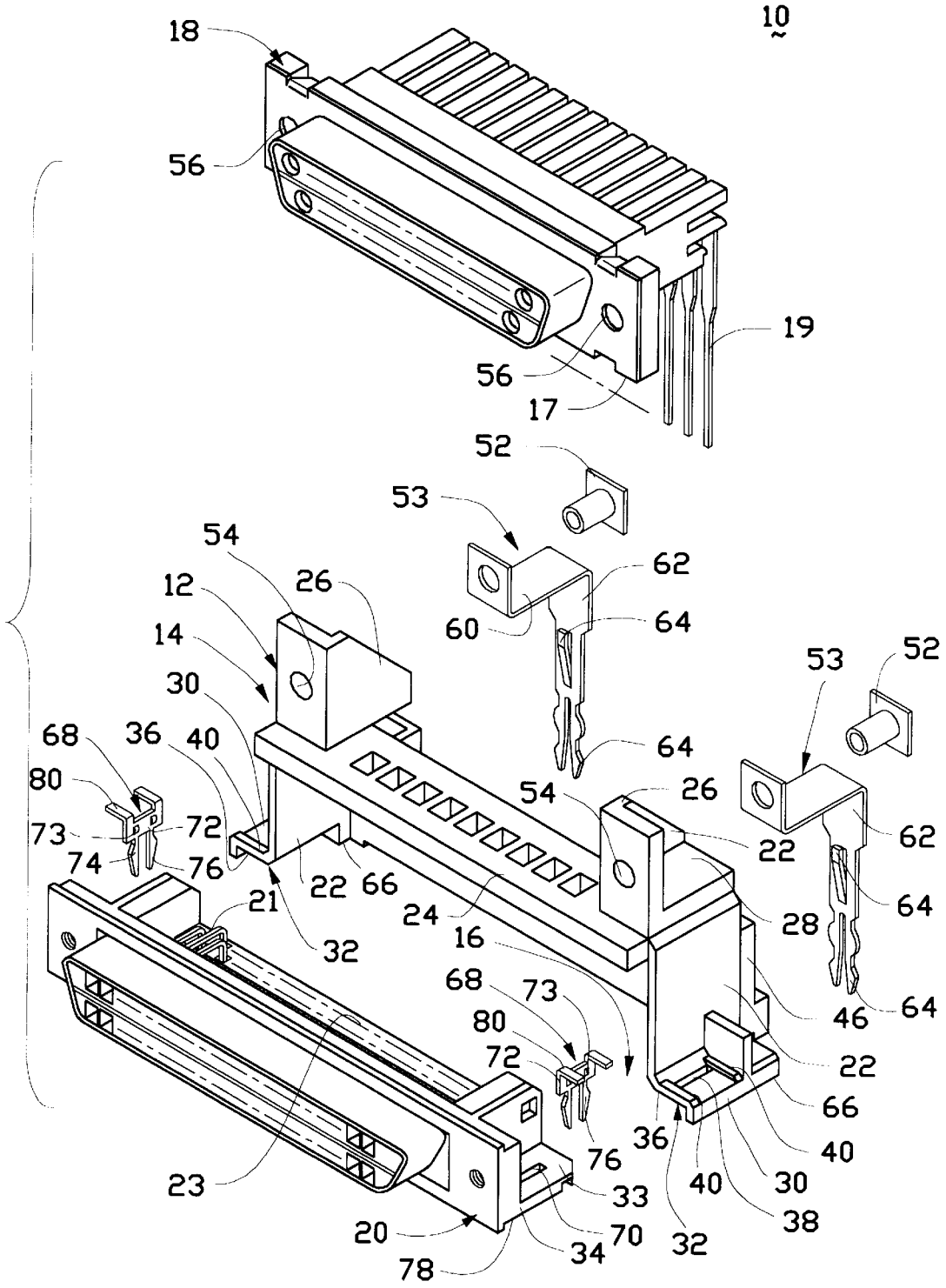
FIG. 1 is an exploded perspective view of a presently preferred embodiment of a stacked type connector assembly according to the present invention.
Figure 2:
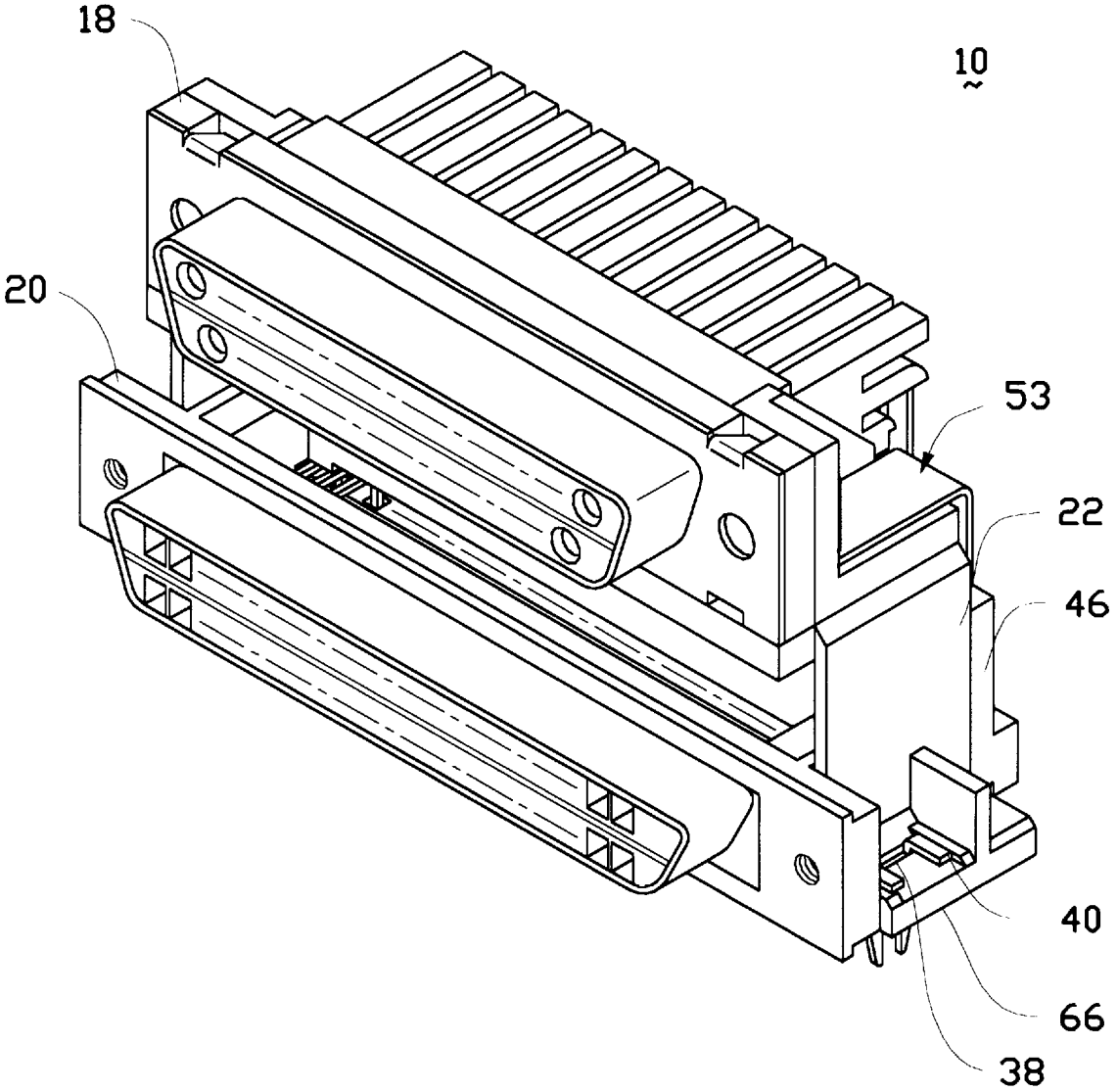
FIG. 2 is a perspective view of the assembled stacked type connector assembly of FIG. 1.

It will be noted here that for a better understanding, most of like components are designated by like reference numerals throughout the various figures in the embodiments. Attention is directed to FIGS. 1 and 2 wherein a stacked type connector assembly 10 includes an insulative bracket 12 defining an upper level portion 14 and a lower level portion 16 thereof for receiving a D-Sub type connector 18 and a SCSI-III type connector therein, respectively.

The bracket 12 includes a pair of side walls 22 and an upper level connector mounting plane 24 horizontally extending therebetween. A tower section 26 is positioned on the top of each side wall 22 with a boardlock mounting surface 28 formed thereon. A pair of lower level connector mounting sections 30 laterally extend by two sides of the side walls 22, each of which defines a receiving cavity 32 for receiving a platform 34 of the connector 20. Each lower level connector mounting section 30 defines a mounting plane 36 on the underside thereof and a slot 38 extends through the mounting plane 36. A pair of ribs 40 and 42 upwardly extend from the topside of the mounting section 30 by two ends of the slot 38.

Figure 3:
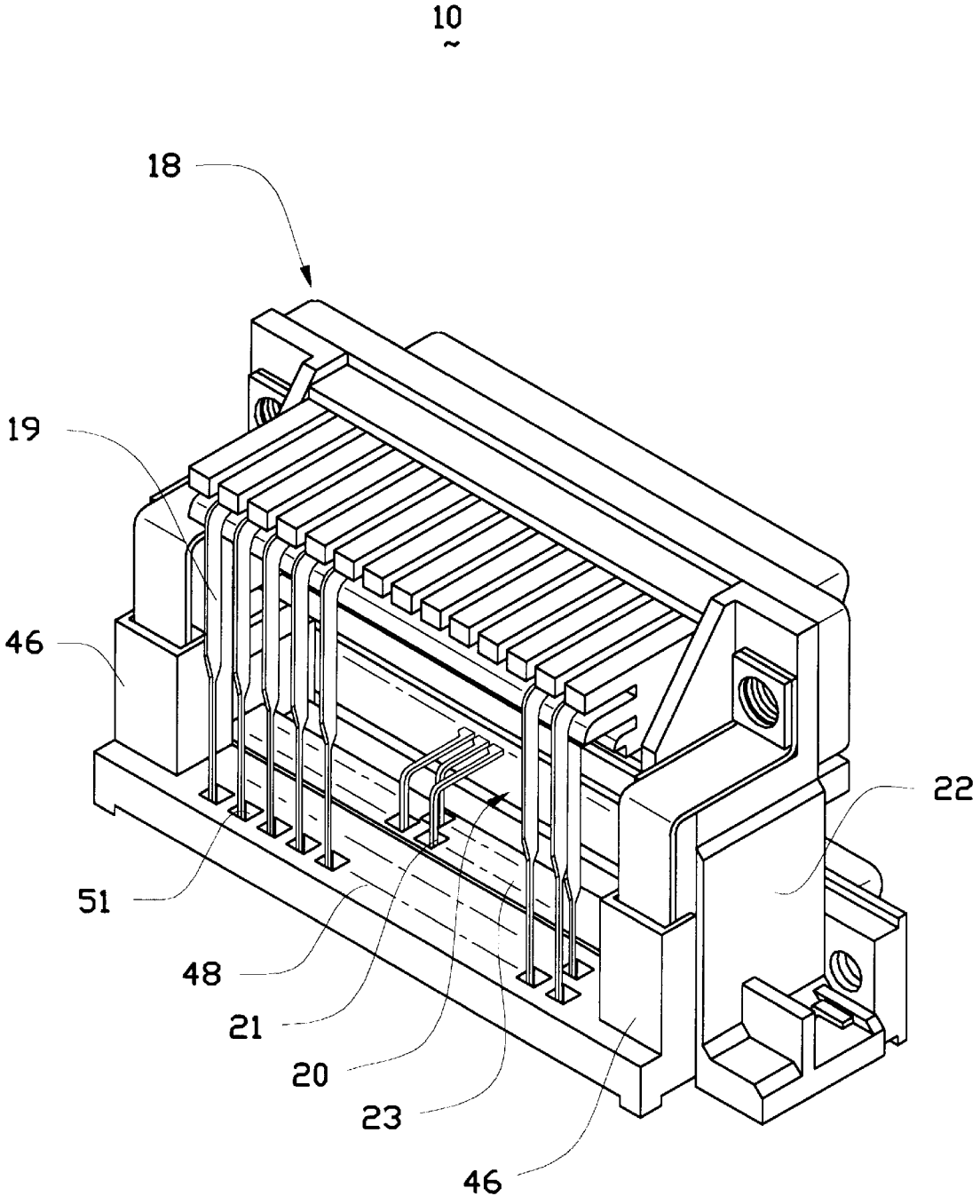
FIG. 3 is a back perspective view of the assembled stacked type connector assembly of FIG. 1.

Also as referring to FIG. 3, a rear portion 44 extending between rear edges of the two side walls 22, includes two vertical sections 46 respectively integrally extending from the side walls 22, and a spacer section 48 horizontally extending between such two vertical sections 46. Each vertical section 46 defines a slit 50 and the spacer section 48 defines a plurality of alignment holes 49 therein.

When assembled, the connector 18 is positioned, from the top, in the upper level portion 16 of the bracket 12 wherein the bottom surface 17 of the connector 18 is seated on the upper level connector mounting plane 24 and a first pair of rivets 52 extend through a first pair of boardlocks 53, the corresponding bracket hole 54 and the connector hole 56 for fastening the connector 18 to the bracket 12. Each of the first pair of boardlocks 53 further includes a horizontal section 60 adapted to be seated on the corresponding tower section 26 of the bracket 12, and a long tail section 62 adapted to be received within the corresponding slit 50 of the vertical section 46 wherein a tang 64 of the leg section 62 can be latchably engaged with the step (not shown) in the slit 50 so that the leg section 62 of the boardlock 53 can not upward moved. Under this situation, a pair of hooks 64 of the leg section 62 project out of the bottom surface 66 of the bracket 12.

Oppositely, the connector 20 is attached to the bracket 12 from the bottom or from the front side wherein the pair of platforms 34 are respectively and snugly received within the corresponding receiving cavities 32 of the lower level connector mounting sections 30 and the mounting planes 36 of the mounting sections 30 abut against the corresponding the top surfaces 33 of the platforms 34, respectively. A second pair of boardlocks 68 respectively extend through the corresponding slots 38 in the mounting section 30 and the corresponding slots 70 in the platforms 34 of the connector 20 for fastening the connector 20 to the bracket 12. Each of the second pair of boardlocks 68 includes a retention portion 72 having embossments 72 thereon for securely interferential engagement within the slot 70 in the platform 34 of the connector 20, a pair of legs 74 extend downward therefrom each with a hook 76 projecting out of the bottom surface 78 of the connector 20, and a pair of arms 80 upward extend therefrom which are adapted to be bent for sandwiching the mounting section 30 between such arms 80 of the boardlock 68 and the top surface 33 of the platform 34 of the connector 20, thus forming the fixation of the connector 20 with regard to the bracket 12.

It is noted that the connector 20 has its own spacer 23 for alignment of its own contacts 21 while the connector 18 aligns its own contacts 19 by means of the alignment holes 49 in the spacer section 48.

It is also seen that the pair of ribs 40 and 42 protectively confine the arms 80 of the second pair of boardlocks 68 therebetween, thus preventing any inadvertent impact imposed onto the arms 80 of the boardlocks 68 and assuring the fastening between the connector 20 and the bracket 12.

In this embodiment, the first pair of boardlocks 53 define a hook direction transverse to that of the second pair of boardlocks 68 so that the whole assembly 10 provides very a stable feature. Although in this embodiment the first and the second connectors are of the D-Sub type and the SCSI-III type, it is understood that other types such as centronics type may be applied instead thereto if desired.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A stacked type connector assembly comprising:

a bracket defining an upper level portion and a lower level portion for respectively receiving a first connector and a second connector therein;

a pair of side walls;

an upper level connector mounting plane defined between said pair of side walls; and a pair of lower level connector mounting planes, whereby the first connector can be mountably attached to the upper level connector mounting plane at a top portion of the bracket and the second connector can be mountably attached to the lower level connector mounting plane at a front bottom portion of the bracket, and wherein a pair of boardlocks are positioned at the lower level connector mounting planes, respectively, for fastening the second connector to the bracket.

2. The assembly as defined in claim 1, wherein a tower section is positioned on a top portion of each of said side walls and a first boardlock is positioned on each said tower section.

3. The assembly as defined in claim 1, wherein each of said lower level connector mounting planes is defined by a lower level connector mounting section, and said lower level connector mounting section further defines a cavity for receiving a platform of the second connector therein.

4. The assembly as defined in claim 3, wherein each of said pair of boardlocks includes a retention section from which a pair of legs downwardly extend and a pair of arms upwardly and successively extend horizontally, and each of said lower level connector mounting sections and said platform of the second connector define slots therein for allowing the corresponding boardlock to extend therethrough.

5. The assembly as defined in claim 4, wherein a pair of ribs are formed on each of the lower level connector mounting sections for protectively confining said corresponding pair of arms therebetween.

6. The assembly as defined in claim 1, wherein said bracket includes a rear portion defining a spacer for alignment of contacts of the first connector.

7. A bracket for use with upper and lower stacked connectors, comprising:

an upper portion and a lower portion for receiving said upper and lower connectors therein, respectively;

a pair of side walls;

an upper level connector mounting plane integrally extending between said pair of side walls; and a pair of lower level connector mounting planes integrally extending outward from the side walls, respectively, wherein each of said lower level connector mounting planes is defined by a lower level connector mounting section in which a slot and a cavity are defined for respectively receiving a second boardlock and a platform of the lower connector therein.

8. The bracket as defined in claim 7, wherein a tower section is formed on each side wall for allowing a first boardlock to be positioned thereon.

9. The bracket as defined in claim 7, further comprising a rear portion forming a spacer for alignment of contacts of the upper connector.

10. An arrangement of stacking an upper connector and a lower connector together, comprising:

a bracket defining an upper portion and a lower portion for respectively receiving said upper connector and said lower connector therein;

an upper connector mounting section formed on the upper portion; and a lower connector mounting section formed on the lower portion; wherein at least one boardlock simultaneously cooperates with the lower connector mounting section and the lower connector for performing both functions of fastening the lower connector to the bracket and retaining the bracket on a PC board on which the bracket with the upper and lower connectors is seated.

11. The arrangement as defined in claim 10, wherein a first slot is formed in the lower connector section and a second slot is formed in a platform of the lower connector, and the boardlock has a retention section extending through both of the first slot and the second slot.

12. The arrangement as defined in claim 11, wherein said boardlock further includes a pair of legs downwardly extending from the retention section, and a pair of arms upwardly extending from the retention section.

13. A connector assembly including first and second stacked connectors, comprising:

a bracket defining a first level portion and a second level portion for respectively receiving said first and second connectors therein;

a pair of first boardlocks attached to the first connector with first hooks downwardly projecting out of a bottom surface of the bracket; and a pair of second boardlocks attached to the second connector with second hooks downwardly projecting out of the bottom surface of the bracket.

14. The connector assembly as defined in claim 13, wherein a first distance between said pair of first boardlocks is smaller than a second distance between said pair of second boardlocks.

15. The connector assembly as defined in claim 13, wherein said first hooks extend in a first direction transverse to a second direction defined by said second hooks.

16. A stacked type connector assembly comprising:

a bracket defining an upper level portion and a lower level portion for respectively receiving a first connector and a second connector therein;

a pair of side walls;

an upper level connector mounting plane defined between said pair of side walls; and a pair of lower level connector mounting planes, whereby the first connector can be mountably attached to the upper level connector mounting plane at a top portion of the bracket and the second connector can be mountably attached to the lower level connector mounting plane at a front bottom portion of the bracket, and wherein a tower section is positioned on a top portion of each of said side walls and a first boardlock is positioned on each said tower section.

17. A stacked type connector assembly comprising:

a bracket defining an upper level portion and a lower level portion for respectively receiving a first connector and a second connector therein;

a pair of side walls;

an upper level connector mounting plane defined between said pair of side walls; and a pair of lower level connector mounting planes, whereby the first connector can be mountably attached to the upper level connector mounting plane at a top portion of the bracket and the second connector can be mountably attached to the lower level connector mounting plane at a front bottom portion of the bracket, wherein a pair of first boardlocks are attached to the first connector and a pair of second boardlocks are attached to the second connector, and wherein hooks of each of the pair of first boardlocks extend in a first direction transverse to a second direction defined by hooks of each of the pair of second boardlocks.

* * * * *